United States Patent [19]

Lyman et al.

[11] 4,364,546

[45] Dec. 21, 1982

[54] MODULAR FENCING ASSEMBLY

[76] Inventors: Oscar Lyman, 1290 San Tomas Aquino Rd., San Jose, Calif. 95117; Ralph Tiegel, 1986 Eaton Ave., San Carlos, Calif. 94070

[21] Appl. No.: 146,065

[22] Filed: May 2, 1980

[51] Int. Cl.[3] ..... E04M 17/16

[52] U.S. Cl. ..... 256/24; 256/19; 256/73; 256/DIG. 5; 52/281

[58] Field of Search ..... 259/24, 19, DIG. 5, 259/13, 1, 59, 73; 52/281, 301

[56] References Cited

U.S. PATENT DOCUMENTS

| | | | |
|---|---|---|---|
| 189,323 | 4/1877 | Root et al. | 256/DIG. 5 |
| 958,619 | 5/1910 | Frazier | 256/19 |
| 2,635,857 | 4/1953 | Banister | 256/19 |
| 2,718,382 | 9/1955 | Bird | 256/19 |
| 3,454,262 | 7/1969 | Romano | 256/19 |
| 3,554,494 | 1/1971 | Bee | 256/19 |
| 3,957,250 | 5/1976 | Murphy | 256/19 |
| 4,063,714 | 12/1977 | Kirkwood | 256/24 |
| 4,188,758 | 2/1980 | Swann | 52/281 X |
| 4,231,552 | 11/1980 | Thomas | 256/24 |

*Primary Examiner*—James Kee Chi

*Attorney, Agent, or Firm*—Benasutti Associates, Ltd.

[57] ABSTRACT

A modular fencing assembly comprising a plurality of posts retained in position at spaced intervals by a foundation, lower channels removably attachable to and extending between adjacent pairs of posts and adapted to engage a fencing panel, upper channels removably attachable to and extending between adjacent pairs of posts and adapted to engage a fencing panel, and fencing panels extending between and retained in position by the upper and lower channels.

7 Claims, 3 Drawing Figures

MODULAR FENCING ASSEMBLY

BACKGROUND OF THE INVENTION

This invention relates generally to the field of fence construction, and in particular, to a modular fencing assembly which is attractive and easily installed.

In general, fencing systems are called upon to satisfy a variety of needs. Primarily, fencing serves the function of subdividing or segregating one area from another, however, it is not uncommon for fencing to serve a decorative or ornamental function as well. Accordingly, for a fencing system to be useful in a wide variety of applications, it is necessary that such a fencing system be attractive as well as sturdy.

Another consideration is the ease or difficulty with which a particular fencing system is installed. For example, an easily installed system which, although attractive, provides limited protection, may be desirable in certain circumstances. However, for other applications, for example, those requiring higher security, such a system may prove unsatisfactory. In such case, a completely different fencing system would be required.

Since the potential applications for fencing vary widely, it is necessary to develop and stock a broad range of fencing materials capable of satisfying these needs. This need to maintain adequate stocks of each of a variety of fencing designs, as well as the need to provide an area sufficiently large to store these various fencing types, results in increased costs to a fencing manufacturer or distributor.

As a further consideration, many fencing applications lend themselves to construction by persons other than those who are skilled in the construction of fences. This is often desirable for both the initial installation, as well as for subsequent repairs. To be adapted for this purpose, a fencing system should be easily installable with a minimum need for specialized tools, in addition to satisfying all of the requirements previously referred to.

It, therefore, becomes desirable to provide a fencing system which is secure, attractive, easily installed, and should the need arise, easily repaired.

SUMMARY OF THE INVENTION

In accordance with the present invention, there is provided a modular fencing system which is particularly well adapted to satisfy a wide variety of fencing needs. The fencing system disclosed generally comprises a series of posts which are concrete filled and formed as part of the foundation, upper and lower channels connected to and between adjacent pairs of the posts, and a fence panel engaged by the upper and lower channels and extending between the adjacent posts.

A modular fencing system is thus provided having several advantages over fencing systems of the prior art. For example, as a result of its modular construction, the fencing system of the present invention is easier to install, permitting its installation by persons other than those skilled in such endeavors. In addition, should repairs ever be required, the modular construction of the fencing system permits rapid repair of the damaged member. Lastly, modular construction enables a manufacturer to provide fencing panels having a wide variety of textures and strength characteristics, satisfying a wide variety of needs while still using substantially standardized components. By standardizing the components comprising the fencing system, reduced demands are placed upon storing a full line of fencing products.

It is, therefore, an object of the present invention to provide a fencing system which is easily installed, and therefore which is suitable for installation by persons other than those skilled in such matters.

It is also an object of the present invention to provide a fencing system which is both secure and attractive in appearance.

It is also an object of the present invention to provide a fencing system having fencing panels which are easily repaired or replaced should the need arise.

It is also an object of the present invention to provide a modular fencing system.

These and other objects will become apparent from the following description, taken in conjunction with the several drawings provided.

BRIEF DESCRIPTION OF THE DRAWINGS

In the several views provided, like reference numerals denote similar structure.

DESCRIPTION OF THE PREFERRED EMBODIMENT

Figure 1:
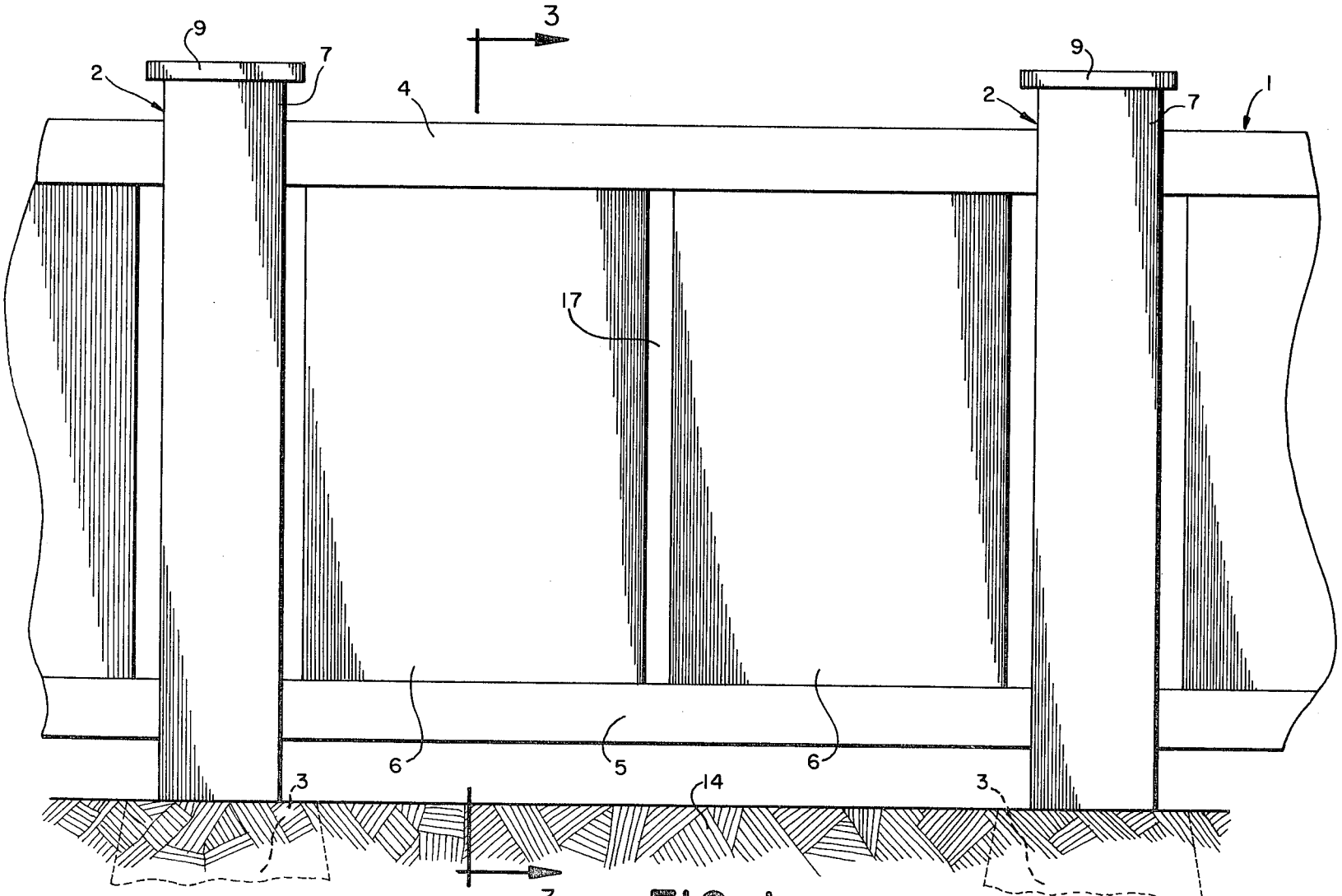
FIG. 1 is a side elevational view of the modular fencing system of the present invention.

Although specific forms of the invention have been selected for illustration in the drawings, and the following description is drawn in specific terms for the purpose of describing these forms of the invention, this description is not intended to limit the scope of the invention which is defined in the appended claims.

Referring now to FIG. 1, a preferred embodiment of the modular fencing system 1 of the present invention is illustrated. The fencing system 1 generally comprises a series of posts 2 mounted within a foundation 3, upper channels 4 and lower channels 5 extending between and connected to adjacent pairs of posts 2, and fencing panels 6 engaged by and extending between upper channels 4 and lower channel 5 and extending between adjacent pairs of posts 2.

Figure 2:
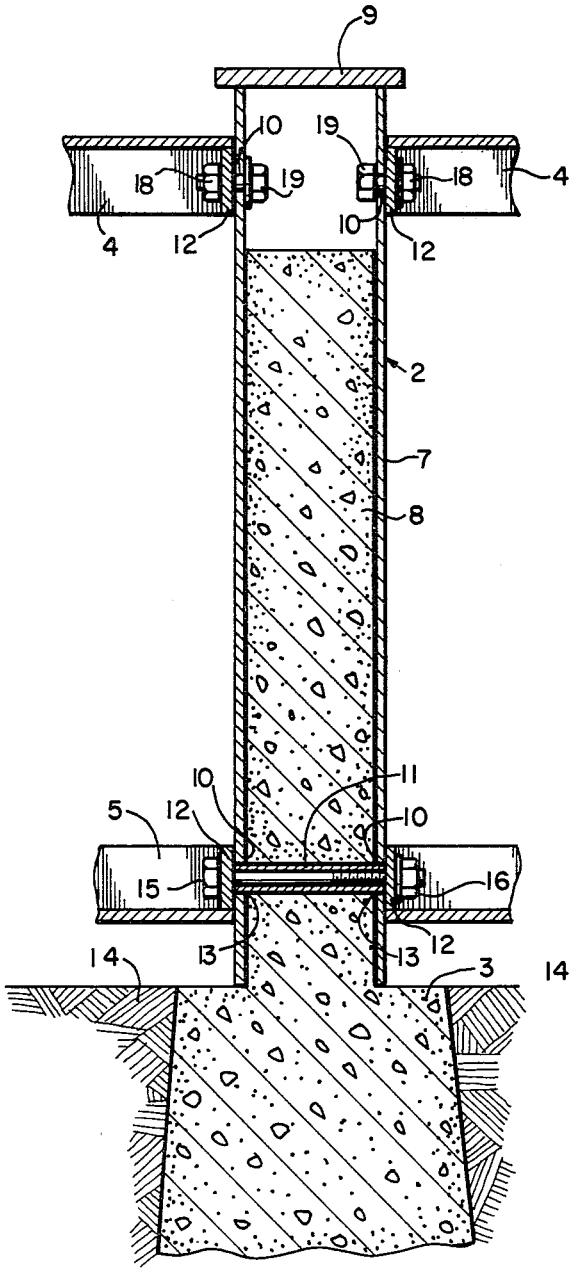
FIG. 2 is a partial, cross sectional view of one of the posts comprising the modular fencing system of the present invention.
Figure 3:
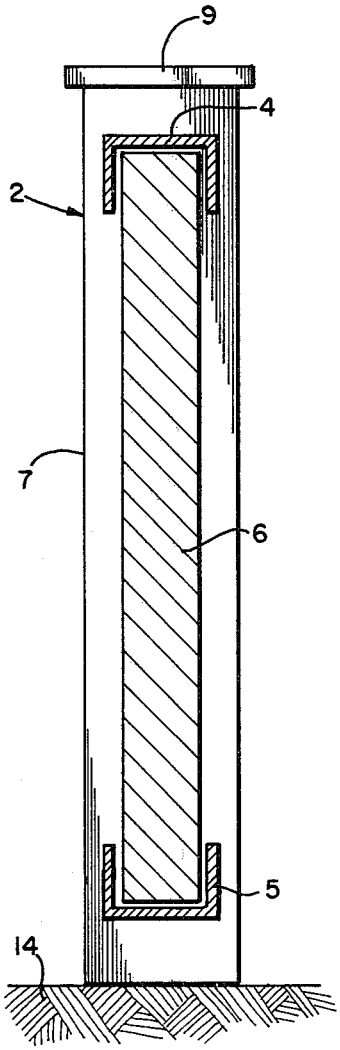
FIG. 3 is a cross sectional view of the modular fencing system of the present invention taken along line 3—3 in FIG. 1.

As illustrated in FIG. 2, each post 2 generally comprises a hollow tubular member 7, the bottom of which is enclosed at foundation 8 and the top of which is enclosed by a finishing cap 9. In addition, the material used to form foundation 8 preferably extends upwardly from foundation 8 into the cavity defined by the hollow tubular member 7, extending at a substantial distance upwardly into the cavity. This is preferred to provide the fencing system 1 with increased strength to provide a secure enclosure. However, should security not be the primary consideration, such as for ornamental fencing systems, filling the cavity of the post 2 in this manner is not essential. In its preferred embodiment, tubular member 7 is shown as having a rectangular cross sectional shape. Clearly, other cross sectional shapes are also possible.

Tubular member 7 is provided with a plurality of openings 10 which are adapted to receive the hardware used to assemble the modular system 1. In addition, it is preferred that a tubular sleeve, such as the pipe 11 illustrated, be positioned to extend between the lower most openings 10 provided in tubular member 7, to maintain an area between the lower most openings 10 which is evacuated of foundation material. This is to permit the insertion of mounting hardware through the lower openings 10 even when the foundation material fills the tubular member 7.

The upper channels 4 and lower channels 5 are generally U-shaped in cross section, extending longitudinally between adjacent post members 7. The ends of the channels 4, 5 are further provided with mounting flanges 12 having openings 13 which are capable of mating with the openings 10 provided in the tubular member 7 for assembly purposes.

The U-shaped portion of channels 4, 5 may be manufactured using any of a variety of techniques. After formation of the U-shaped portions of channels 4, 5, the channels 4, 5 may then be cut to size, preferably having a standardized length. Lastly, the flanges 12 may be attached to the ends of the U-shaped portion of channels 4, 5, for example, by welding or some other appropriate technique.

Fencing panels 6 are preferably rectangular in shape and are dimensionally configured to extend between the upper channel 4 and lower channel 5 connecting adjacent pairs of posts 2. The surfaces of the panels 6 are preferably substantially planar, and may be textured if desired for a particular application.

Fencing panels 6 may be formed using a variety of materials. For example, solid or latticed fencing panels 6 may be formed of a metal such as iron or steel, providing a secure enclosure. Other materials may be used to provide an attractive fenced enclosure, if desired. A particularly interesting panel 6 can be produced using a stone aggregate and acrylic plastic combination of materials, producing a durable and attractive textured panel surface. Irrespective of the material used to form the panels 6, a wide variety of colors and textures are possible.

Installation of the modular fencing system 1 of the present invention will now be described in greater detail. First, as is customary, the surface 14 into which the modular fencing system 1 of the present invention is to be mounted is first provided with a series of holes which will subsequently receive the tubular members 7 which support the fencing system 1 in position.

Second, the foundation 8 would be poured around the tubular members 7, which have been placed in position in the holes. In most applications a concrete foundation would be used. As previously described, for added support, additional foundation material is also preferably poured within the cavity defined by the tubular member 7, preferably to the level shown.

After the foundation sets, the modular fencing system 1 is ready for assembly. In assembling the fencing system 1, the lower channels 5 are first placed in position. To secure the lower channels 5 in position, a series of bolts 15 and nuts 16 are positioned through the openings 13 in the flanges 12, also extending through the openings 10 in tubular post member 7 and the sleeve pipe 11. The resulting assembly is suitably tightened, securely retaining the lower channels 5 to the tubular members 7. It is to be noted that the presence of the sleeve pipe 11 assists in placement of the bolt 15 through tubular member 7, as previously described, even after the foundation material has set within the tubular member 7. This is preferred to facilitate assembly of the fencing system 1.

After installation of the lower channels 5, the fencing panels 6 are then placed in position. To do so, the lower edge of a panel 6 is positioned within the U-shaped area defined by the lower channel 5, which U-shaped area is positioned to face upwardly during the installation of the channel 5. In this manner, an installed panel 6 is supported and securely retained within the lower channel 5.

As illustrated in FIG. 1, more than one panel 6 may be placed between an adjacent pair of tubular members 7 if desired. Should an assembly having a unitary appearance be preferred, adjacent panels 6 would be placed within the lower channel 5 so that their transverse edges abut. Should it be preferred to leave one or more spaces 17 between adjacent fencing panels or between a fencing panel 6 and one of the post members 7, this also may be done.

After installation of the panel or panels 6 in position, the assembly is completed by mounting the upper channels 4 in place. In doing so, the U-shaped area defined by the upper channel 4 is positioned to face downwardly over the panel or panels 6, resting on top of and engaging their uppermost edges. It then remains necessary to connect the upper channels 4 to the tubular members 7. To facilitate this process, it is preferred that a nut 18 be welded to the flanges 12 associated with the upper channel 4 so that an upper channel 4 which has been placed in position can easily be engaged by bolts 19 extending through the openings 10 provided at the upper end of tubular member 7. Upon tightening the bolts 19, a secure fencing system results. Cap 9 is then placed over the top of tubular member 7, enclosing tubular member 7 and providing the modular fencing system 1 with a finished look.

Should one of the fencing panels 6 ever become marred or damaged, or should replacement of an entire series of panels become desirable, the modular fencing system 1 of the present invention is particularly well adapted to facilitate this process. The cap 9 enclosing the upper portion of tubular member 7 would first be removed. The bolts 19 retaining the upper channels 4 in place would then be removed. Next, the upper channels 4 would be removed, disengaging the fencing panels 6 comprising the original fencing system 1. Any panels to be replaced would be removed, and any new panels would be placed in position within the U-shaped portion of the lower channels 5. The upper channels 4 would then be placed in position over the panels 6, and bolted into position as previously described. Lastly, the caps 9 would be replaced over the tubular members 7, providing a finished fencing structure.

It will be understood that various changes in the details, materials and arrangement of parts which have been herein described and illustrated in order to explain the nature of this invention may be made by those skilled in the art within the principle and scope of the invention as expressed in the following claims.

What is claimed is:

1. A modular fencing assembly comprising:

(a) a plurality of hollow post members positioned at spaced intervals and retained in place by a foundation;

(b) a lower channel having a U-shaped cross-section over its length, removably but securely attached to, and extending between an adjacent pair of post members by first attaching means, and adapted to engage a fencing panel therein;

(c) an upper channel having a U-shaped cross-section over its length, removably but securely attached to, and extending between said adjacent pair of post members, and adapted to engage a fencing panel therein;

(d) second attaching means for said channel being accessible from within said hollow post member;

(e) at least one fencing panel extending between and retained in position by the upper and the lower channels wherein said first attaching means is accessed by removing said panel from said lower channel.

(f) cap means located upon the top of said hollow post member.

2. The assembly of claim 1 wherein the fencing panel is formed of a stone aggregate and acrylic combination.

3. The apparatus of claim 1 wherein the material forming the foundation extends upwardly into a cavity defined by the hollow post member.

4. The assembly of claim 3 wherein the upper and lower channels retained to the hollow post member by said first and second attaching means extending through a plurality of apertures provided in the post member, and wherein the post member further comprises at least one sleeve extending between the apertures.

5. The assembly of claim 4 wherein the sleeve extends between the apertures used to connect the lower channels to the post members.

6. The assembly of claim 4 wherein said attaching means comprises a nut and bolt combination which is tightened with sufficient torque to provide a secure fencing system.

7. A method of making a modular fence having at least two permanently located hollow posts at a spaced interval, comprising the steps of:

(a) positioning a channel, having a U-shaped cross-sectional area across its entire length, at a relatively low level and between said posts, such that an opening in said channel is facing upwardly, said channel being attached to said post by means which is externally accessible;

(b) locating a panel in an upright position within said U-shaped channel;

(c) positioning a second channel, having a U-shaped cross-sectional area across its entire length upon said panel such that an opening of said channel is facing downwardly;

(d) said second U-shaped channel being attached to and accessible from within said hollow post to prevent easy removal thereof; and (e) having access to said means for attaching said upwardly facing channel to said posts by removing said panel (f) locating a cap upon said hollow post members.

* * * * *